US009447949B2

(12) United States Patent
Rashidi Doust

(10) Patent No.: US 9,447,949 B2
(45) Date of Patent: Sep. 20, 2016

(54) LIGHT FIXTURE

(71) Applicant: Hamid Rashidi Doust, Beverly Hills, CA (US)

(72) Inventor: Hamid Rashidi Doust, Beverly Hills, CA (US)

(73) Assignee: Elite Lighting, Commerce, CA (US)

( * ) Notice: Subject to any disclaimer, the term of this patent is extended or adjusted under 35 U.S.C. 154(b) by 13 days.

(21) Appl. No.: 14/262,670

(22) Filed: Apr. 25, 2014

(65) Prior Publication Data

US 2015/0308664 A1 Oct. 29, 2015

(51) Int. Cl.

| | |
|---|---|
| ***F21V 1/00*** | (2006.01) |
| ***F21V 5/00*** | (2015.01) |
| ***F21V 7/00*** | (2006.01) |
| ***F21V 17/02*** | (2006.01) |
| ***F21V 23/02*** | (2006.01) |
| ***F21V 13/06*** | (2006.01) |
| *F21Y 103/00* | (2016.01) |

(52) U.S. Cl.
CPC ..... *F21V 17/02* (2013.01); *F21V 13/06* (2013.01); *F21V 23/026* (2013.01); *F21Y 2103/003* (2013.01)

(58) Field of Classification Search
CPC ..... F21V 17/02; F21V 23/026; F21V 13/06; F21Y 2013/003
USPC ..... 362/217.05, 221, 217.11, 217.01
See application file for complete search history.

(56) References Cited

U.S. PATENT DOCUMENTS

| | | | | |
|---|---|---|---|---|
| 2,534,992 | A * | 12/1950 | Reid | F21S 8/00 362/374 |
| 2,926,237 | A * | 2/1960 | Sorenson | F21V 17/107 362/150 |
| 2,981,829 | A * | 4/1961 | Rosenblatt | F21V 21/04 362/220 |
| 3,087,981 | A * | 4/1963 | Harling | 174/542 |
| 3,560,729 | A | 2/1971 | Liberman | |
| 5,121,309 | A * | 6/1992 | Ewing | F21V 7/0025 362/294 |
| 6,758,580 | B1 | 7/2004 | Verfuerth | |
| 6,942,364 | B1 * | 9/2005 | Wegner et al. | 362/281 |
| 7,244,058 | B2 | 7/2007 | DiPenti et al. | |
| 7,261,436 | B2 | 8/2007 | Haugaard et al. | |
| 7,329,022 | B2 | 2/2008 | Tran et al. | |
| 7,926,985 | B2 | 4/2011 | Teng et al. | |
| 7,963,672 | B2 | 6/2011 | Liu et al. | |
| 8,100,551 | B2 * | 1/2012 | Mayfield et al. | 362/223 |
| 8,136,958 | B2 | 3/2012 | Verfuerth et al. | |
| D662,256 | S | 6/2012 | Klu | |

(Continued)

FOREIGN PATENT DOCUMENTS

| | | |
|---|---|---|
| WO | WO2010/095710 | 8/2010 |
| WO | WO2011/068114 | 6/2011 |

(Continued)

OTHER PUBLICATIONS

Lithonia High Bay, Nov. 17, 2013.

*Primary Examiner* — Anh Mai
*Assistant Examiner* — Glenn Zimmerman
(74) *Attorney, Agent, or Firm* — Payam Moradian

(57) ABSTRACT

Provided is a light fixture comprising: a) a body for attaching one or more ballast; b) a bracket having a first and a second end that is pivotally attached at the first end to the body; and c) a reflector for placement of one or more LED (light emitting diode) strips attached to the bracket. The fixture can further comprise a door with a lens pivotally attached to the body, wherein the ballast is accessed by pivoting the reflector and the door in opposite directions.

22 Claims, 21 Drawing Sheets

(56) References Cited

U.S. PATENT DOCUMENTS

| | | | | |
|---|---|---|---|---|
| D664,706 | S | 7/2012 | Schieffelin et al. | |
| 8,337,043 | B2 | 12/2012 | Verfuerth et al. | |
| 8,376,583 | B2 | 2/2013 | Wang et al. | |
| 8,529,085 | B2 | 9/2013 | Josefowicz et al. | |
| 2005/0015750 | A1 | 1/2005 | Sley | |
| 2005/0026501 | A1 | 2/2005 | Zhan | |
| 2007/0153526 | A1* | 7/2007 | Lim | 362/294 |
| 2008/0025959 | A1 | 1/2008 | Daneman et al. | |
| 2008/0062689 | A1* | 3/2008 | Villard | 362/250 |
| 2009/0009989 | A1* | 1/2009 | Verfuerth et al. | 362/157 |
| 2011/0001060 | A1* | 1/2011 | Welker | 250/455.11 |
| 2011/0279063 | A1* | 11/2011 | Wang et al. | 315/313 |
| 2012/0002411 | A1 | 1/2012 | Ladewig | |
| 2012/0281397 | A1* | 11/2012 | Kong | 362/225 |
| 2013/0008352 | A1 | 1/2013 | Roddy | |
| 2013/0155670 | A1 | 6/2013 | Handsaker | |
| 2014/0104843 | A1* | 4/2014 | McCane et al. | 362/282 |
| 2014/0268759 | A1* | 9/2014 | Vang et al. | 362/240 |
| 2014/0355272 | A1* | 12/2014 | Chou | F21S 4/008 362/308 |

FOREIGN PATENT DOCUMENTS

| | | |
|---|---|---|
| WO | WO2011/118974 | 9/2011 |
| WO | WO2013/162183 | 8/2013 |
| WO | WO2013/129362 | 9/2013 |

* cited by examiner

FIG 19B
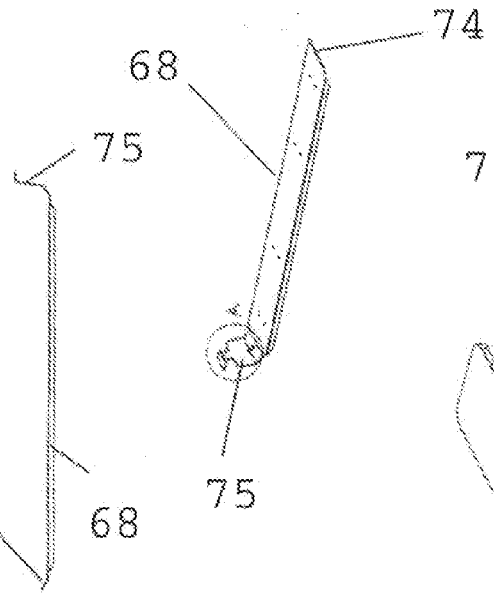
FIG 19A
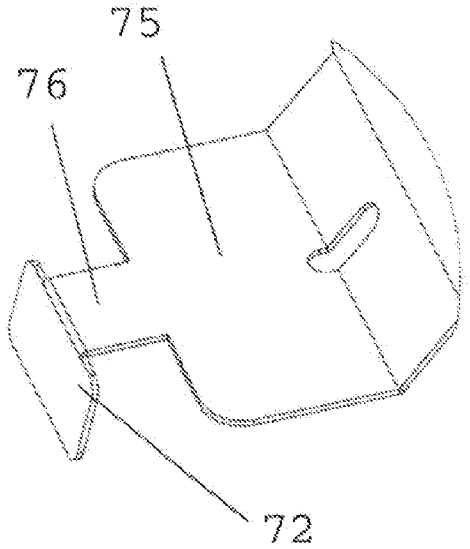
FIG 19C

LIGHT FIXTURE

BACKGROUND SECTION OF THE INVENTION

Light Emitting Diodes ("LED") have become increasingly popular due to their low electricity usage. Light Emitting Diodes have begun replacing fluorescent lights in light fixtures.

A problem that exists with LED lights, particularly those that hang from a ceiling, is that they are not easy to maintain. A technician may have to take off the entire light fixture to service the fixture.

There is a need in the art to allow an easy to maintain LED light fixture that hangs from a ceiling while at the same time providing good lighting, heat dissipation, and be suitable for a manufacturing process on an industrial scale.

SUMMARY SECTION OF THE INVENTION

Provided is a light fixture comprising: a) a body for attaching one or more ballast; b) a bracket having a first and a second end that is pivotally attached at the first end to the body; and c) a reflector for placement of one or more LED (light emitting diode) strips attached to the bracket. The fixture can further comprise a door with a lens pivotally attached to the body, wherein the ballast is accessed by pivoting the reflector and the door in opposite directions.

Provided is a light fixture comprising: a) a body for attaching one or more ballast; b) a bracket having a first and a second end that is pivotally attached at the first end to the body; c) a reflector for placement of one or more LED (light emitting diode) strips attached to the bracket; d) a door with a lens pivotally attached to the body; wherein the ballast can be accessed by pivoting the reflector and the door in opposite directions. The reflector can be a flat reflector. The reflector can have cavities formed by protrusions for placement of multiple LED strips, with one protrusion forming a space in between the reflector and the body for placement of the ballast. The reflector can comprise of five protrusions, with a central protrusion having a horizontal top portion, two triangular protrusions, and two slanting protrusions. The body can be comprised of a top horizontal portion that borders downwardly slanting portions, with each slanting portion further bordering downwardly vertical portions, with all portions running parallel in respect to each other. The fixture can comprise one or more ballasts in a compartment formed by the body by attaching the ballast inside of the compartment to the horizontal top portion of the body. The fixture can comprise a mounting frame attached to the lower tip of the downwardly portion of the body and running parallel with the body. The mounting frame can creates a U shaped gap. The door can be secured by matching screw holes on the mounting frame. An end frame can be attached in transverse direction to the body. The body can be made from a single piece of metal. The bracket can rest on the body with a hanging member at the first end and is detachably attached to the body at the second end. The fixture can further comprise a slot on the body for having the first end of the bracket go through to allow for the bracket to pivot. The slot can be a T-slot. The slot can be a vertically downwardly portion of the body. The bracket can sit on the slot with a member hanging out from the body and being in a gap formed in between a mounting frame and the body. The reflector can be attached to the bracket with screws. The fixture can further comprise LED strips placed on the reflector on the side of the reflector not facing the body. The bracket holding the reflector can be removed altogether through a slot on the body.

BRIEF DESCRIPTION OF THE DRAWINGS

FIG. 17A illustrates a bracket attached.

FIG. 19A illustrates a side view of the bracket.

FIG. 19B illustrates a perspective view of the bracket.

FIG. 19C illustrates the shape of a member that goes through a T-slot.

DETAILED DESCRIPTION OF THE INVENTION

Figure 1:
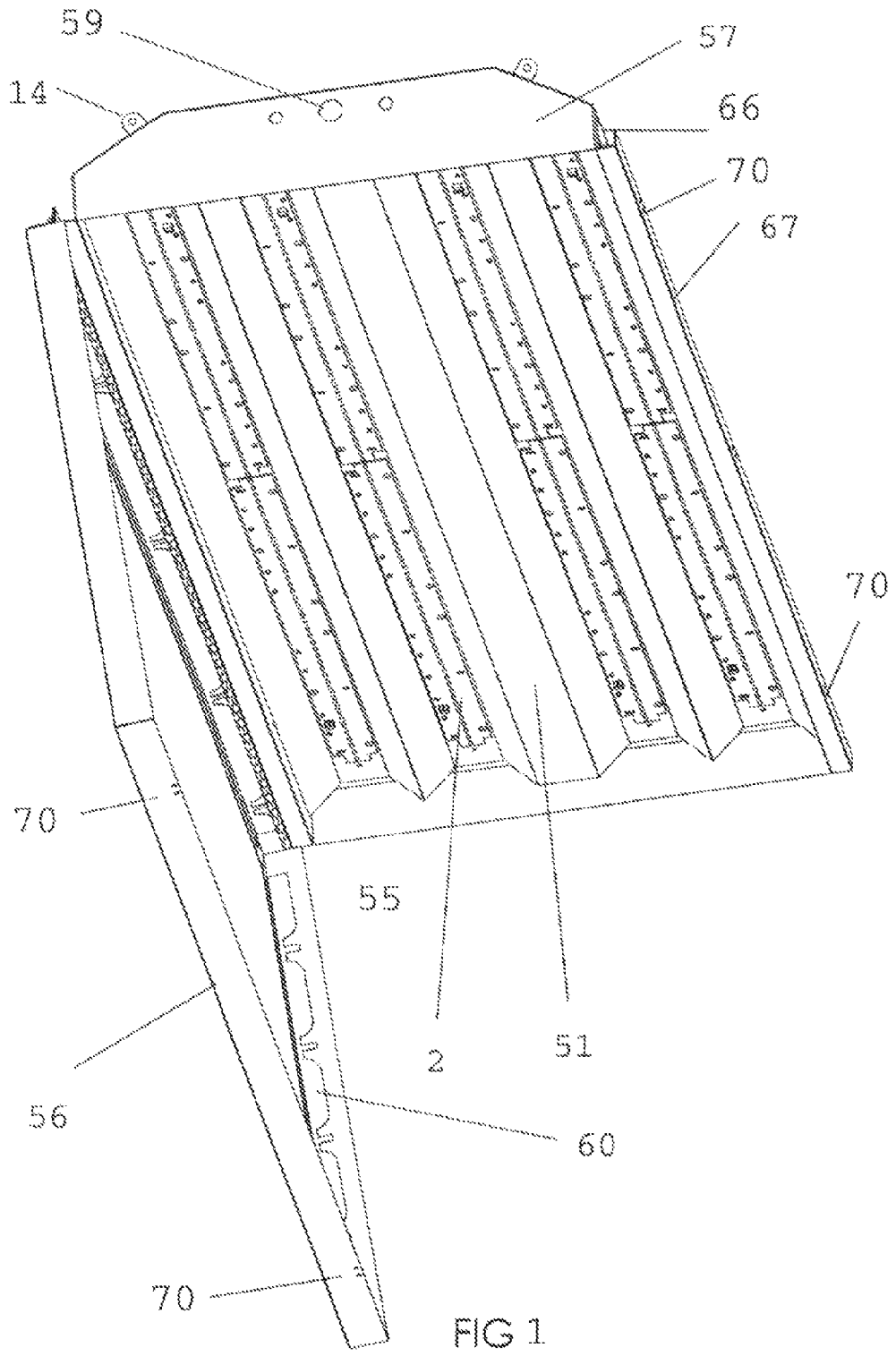
FIG. 1 illustrates a bottom perspective view of the fixture with its door open.

The present invention provides a hanging light (high bay) that allows easy access to ballasts and LED light strips. In this embodiment, a body (66) is provided having a horizontal top surface (53) with slanting downward sections (54) on each side. Each slanting down portion has attached thereto a vertical section (67). The vertical section (67) and the horizontal top surface (53) are perpendicular to each other. The horizontal top surface can have a hanger (21) for wires to pass the junction box and/or for hanging the fixture from the ceiling. The slanting downward sections (54) can have plurality of vents (52) that allow for movement of air and cooling down of the light fixture. Members (14) for hanging the light fixture to the ceiling project upward, in the illustrated embodiments from the slanting portions. An end frame (57) can be attached to each side of the body. The end frame (57) can have openings (59) for passage of wires. A door (56) is attached to a long side of the body (66) with a hinge (55). The door (56) holds a lens (68) and pivots to an open and a closed position. The door (56) can have holders (69) to keep the lens (68) in place.

FIG. 1 illustrates a bottom perspective view of the light fixture with its door (56) open. The fixture has LED strips (2) fixed on a reflector (51) which is attached to the body (66) of the light fixture. End frames (57) are placed at opposite sides of the body (66). The end frame (57) can have an opening (59) for passage of wires. Member (14) can be used to hang the fixture from the ceiling. The body (66) also has a mounting frame (67) with screw holes (70) which correspond to screw holes (70) on door (56), and allows for securely holding the door (56) in place with a fastener like a screw. The mounting frame (67) generally runs parallel to the long side of the light fixture.

Figure 2:
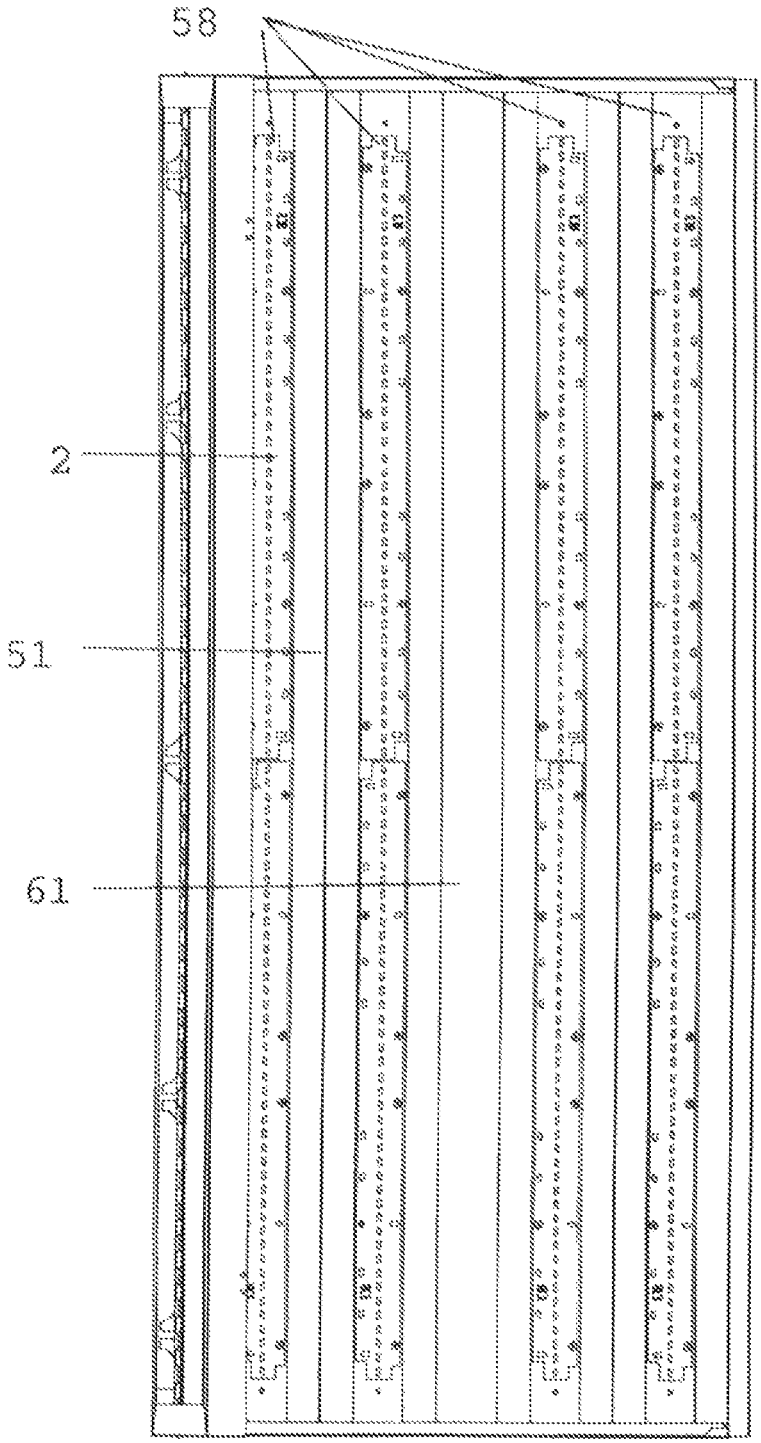
FIG. 2 is a bottom view of the fixture.

FIG. 2 is a bottom view of the fixture. Four LED strips (2) are placed on top of reflector (51). The reflector can have four cavities (58) for placement of the LED strips (2). The Reflector central protrusion (61) can be more bulky than other portions of the reflector (51) surrounding the LED strip (2). The inside of the Reflector central protrusion (61) can be used to place electronics such as ballast.

Figure 3:
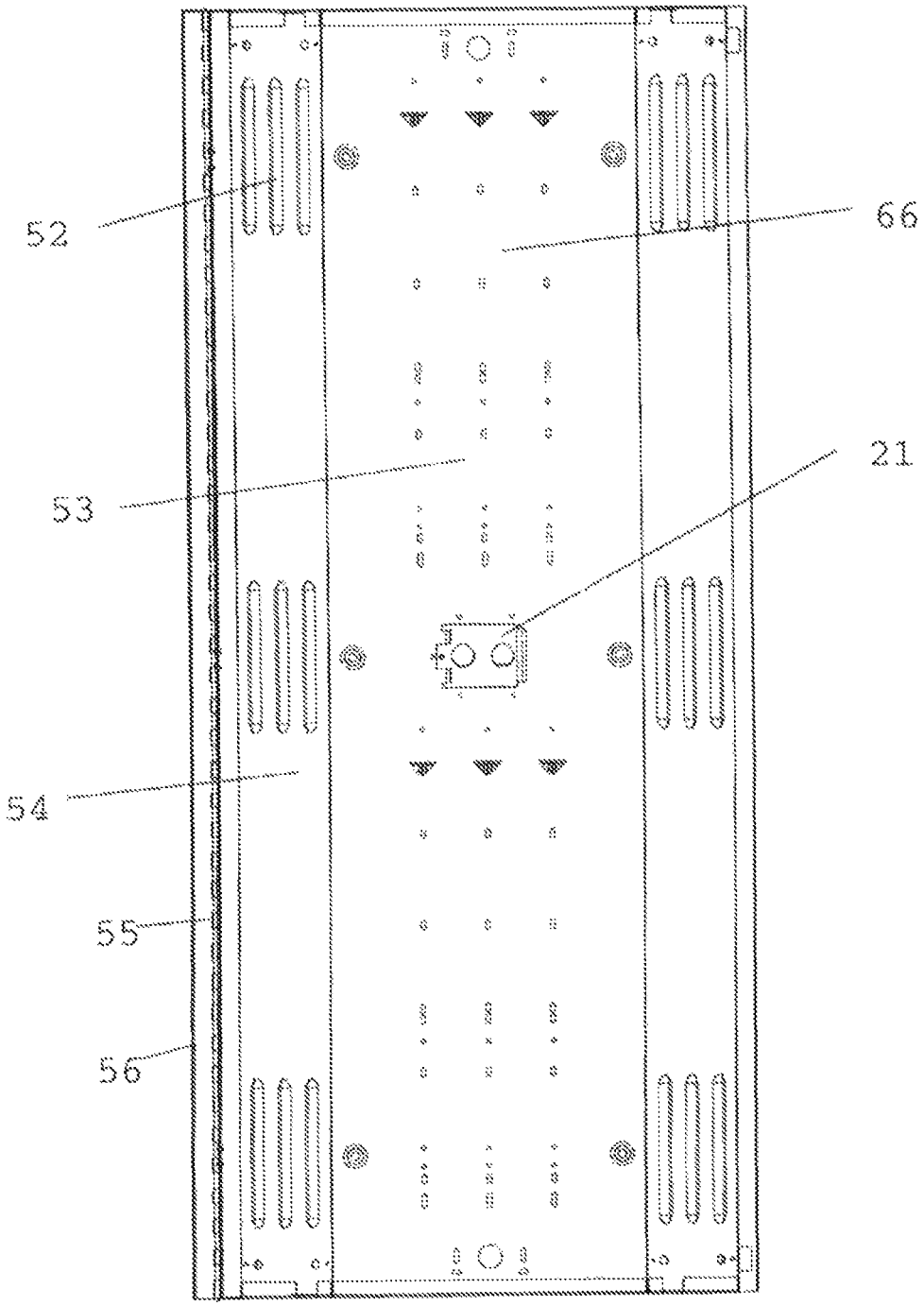
FIG. 3 is a top view of the light fixture.

FIG. 3 is a top view of the light fixture. The horizontal top surface (53) of the LED light borders slanting portions (54) on each side and an have a hanger (21). The slanting portions (54) can have a plurality of vents (52). Door (56) is pivotally attached to the body (66) via hinge (55).

Figure 4:
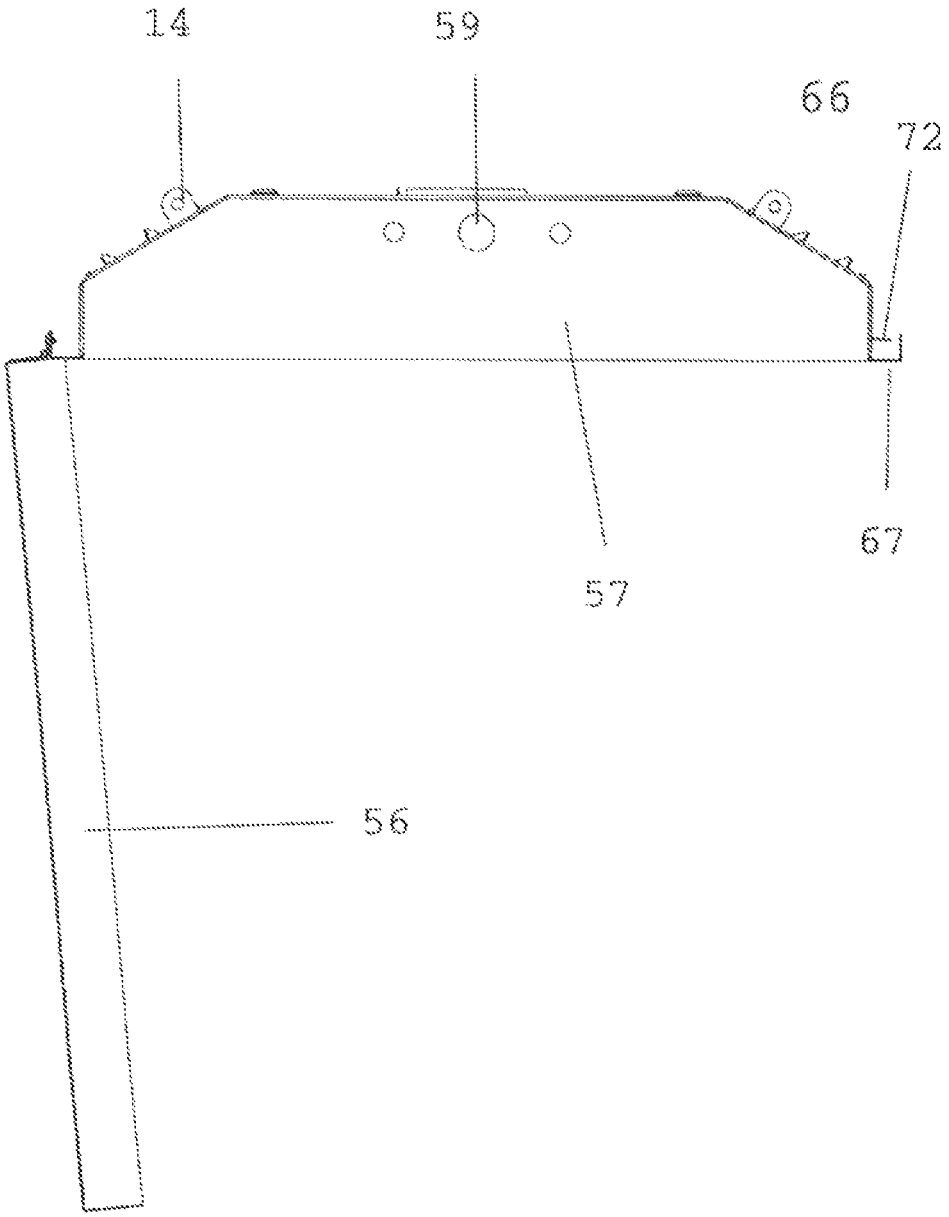
FIG. 4 is a side view of the light fixture with end panel.

FIG. 4 is an end view of the light fixture with end frame (57). Also shown is pivotally attached door (56). Opening (59) on end frame (57) allows for passage of wires. Member (14) allows for hanging the fixture from ceiling. Also shown is mounting frame (67). A gap forms in between the mounting frame (67) and the body (66). This gap allows for screwing the door (56) to the mounting frame (67). Also shown is resting member (72) of the bracket which extends from a T-slot in the body and is positioned in this gap.

Figure 5:
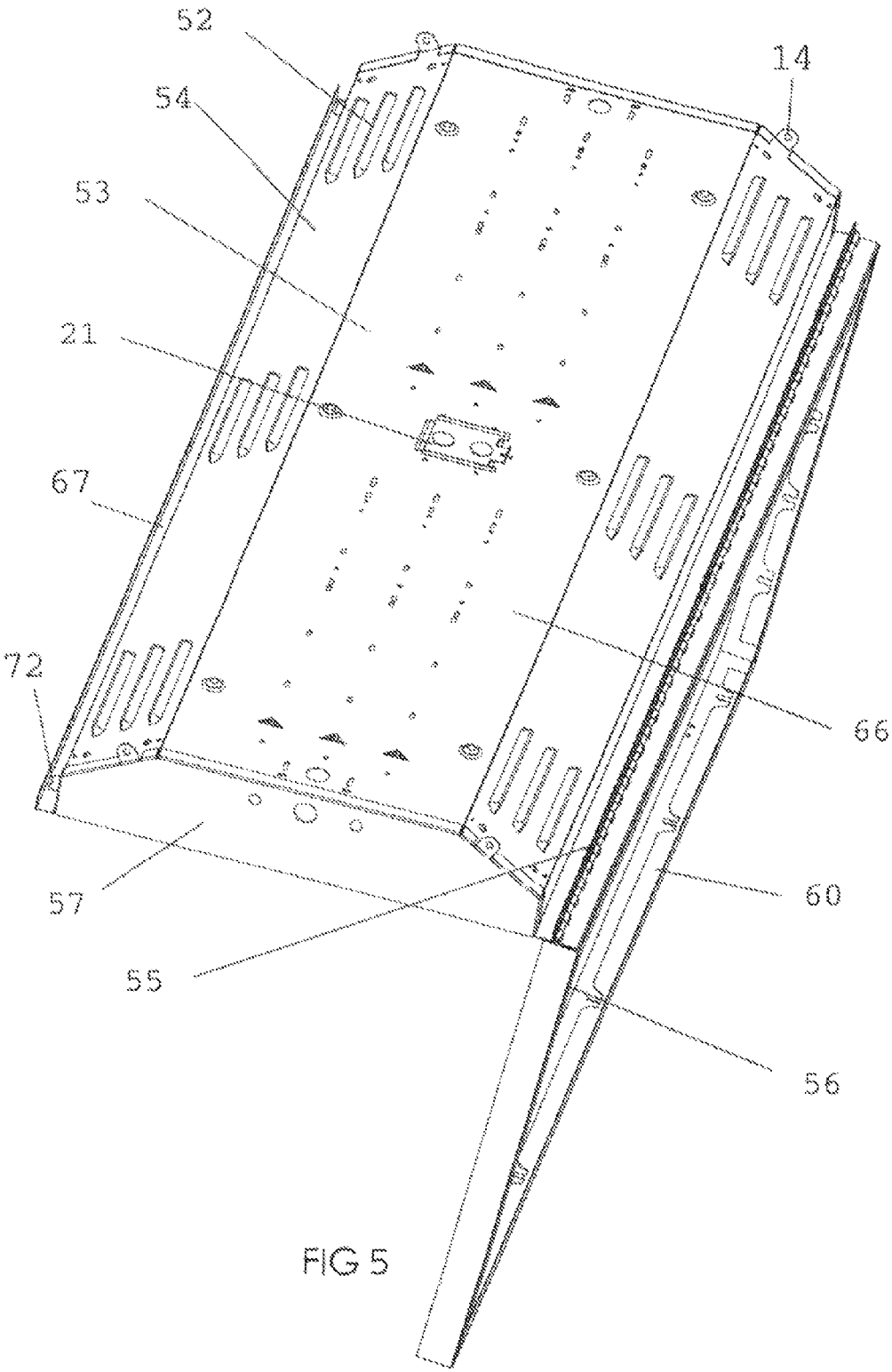
FIG. 5 is a top perspective view of the light fixture.

FIG. 5 is a top perspective view of the light fixture. The horizontal top portion (53) of the light fixture borders slanting portions (54) on each side. The horizontal top portion (53) can also have a hanger (21). The slanting portion (54) can have a plurality of vents (52). Door (56) is pivotally attached to the body via hinge (55). Door (56) has holders (60) for holding the lens. Member (14) allows for hanging the fixture from ceiling. An end frame (57) with an opening for passage of wires (59) is attached to each end of the body (66). A gap forms in between the mounting frame (67) and the body (66). This gap allows for screwing the door (56) to the mounting frame (67). Also shown is resting member (72) of the bracket which extends from a T-slot in the body and is positioned in this gap.

Figure 6:
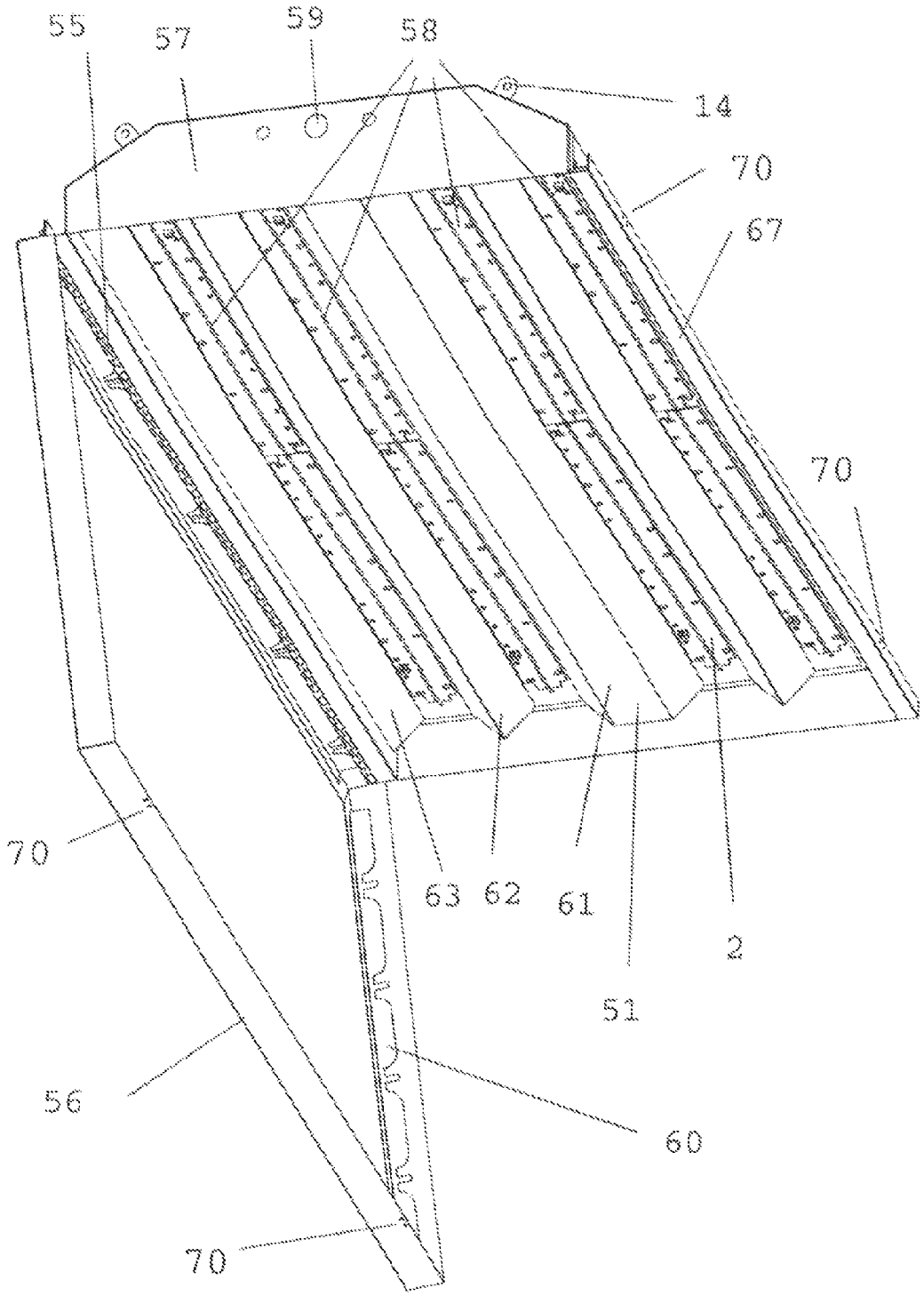
FIG. 6 is a bottom perspective view of the light fixture.
Figure 7:
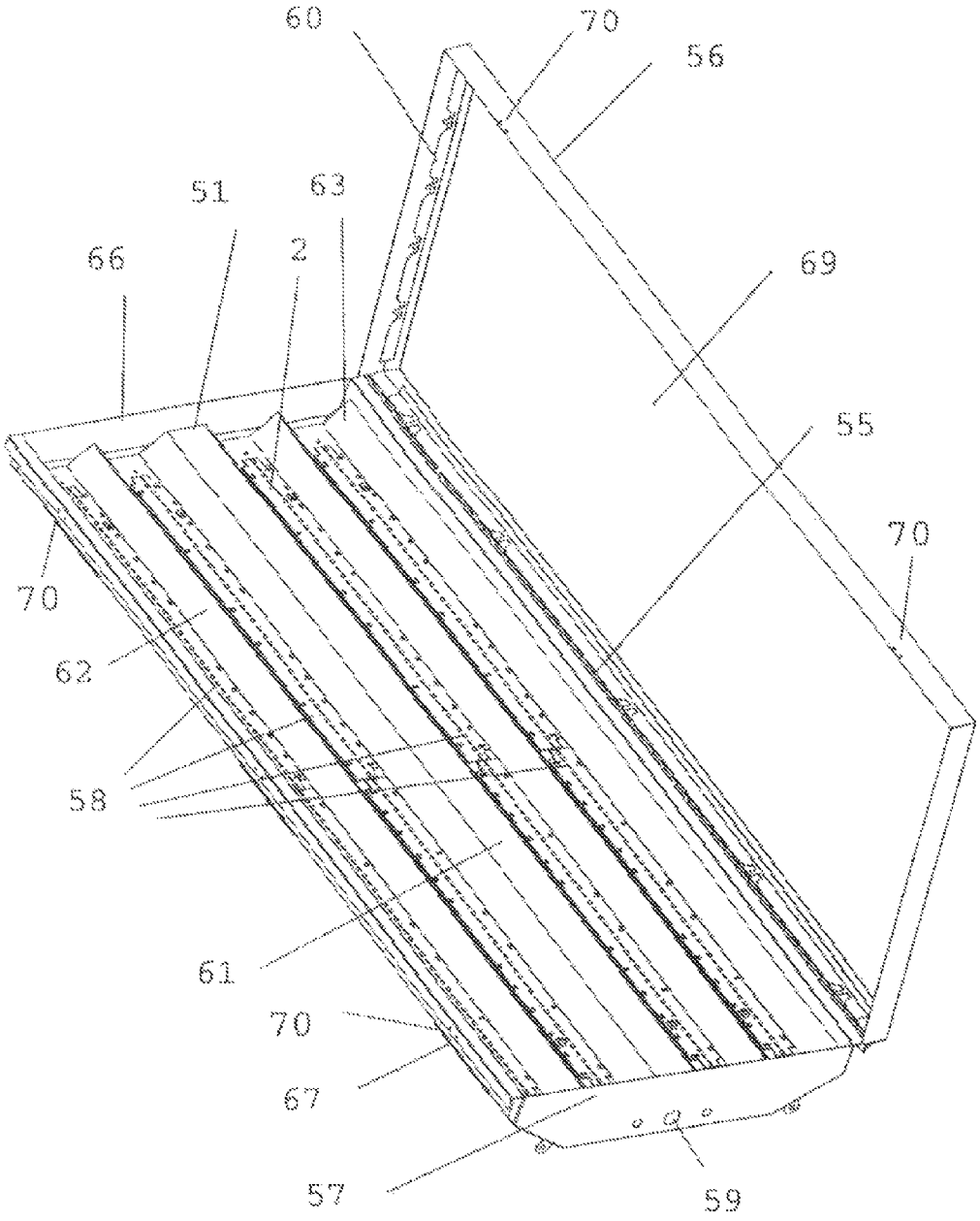
FIG. 7 is a perspective view of the light fixture.

FIG. 6 is a bottom perspective view of the light fixture and FIG. 7 is another perspective view of the light fixture. Four LED strips (2) are placed in each cavity (58) of a reflector (51) attached to the body (66) of the light fixture. A reflector (51) with different number of cavities (58) can be used. The cavities (58) of the reflector (51) are caused by upward protrusions in the reflector (51). The central protrusion (61) can have a flat top surface and straight or slanting side portions. The central protrusion (61) creates a cavity that allows for passage of wires from opening (35) of the end frame (57). The additional protrusions can be triangular in shape (62) formed by two slanting portions joining each other. The reflector can have a single slanting protrusion (63) at each side to fit against the body. Also illustrated is mounting frame (67) with matching screw holes (70) with door (56) for securing the door (56) to the body (66).

Figure 8:
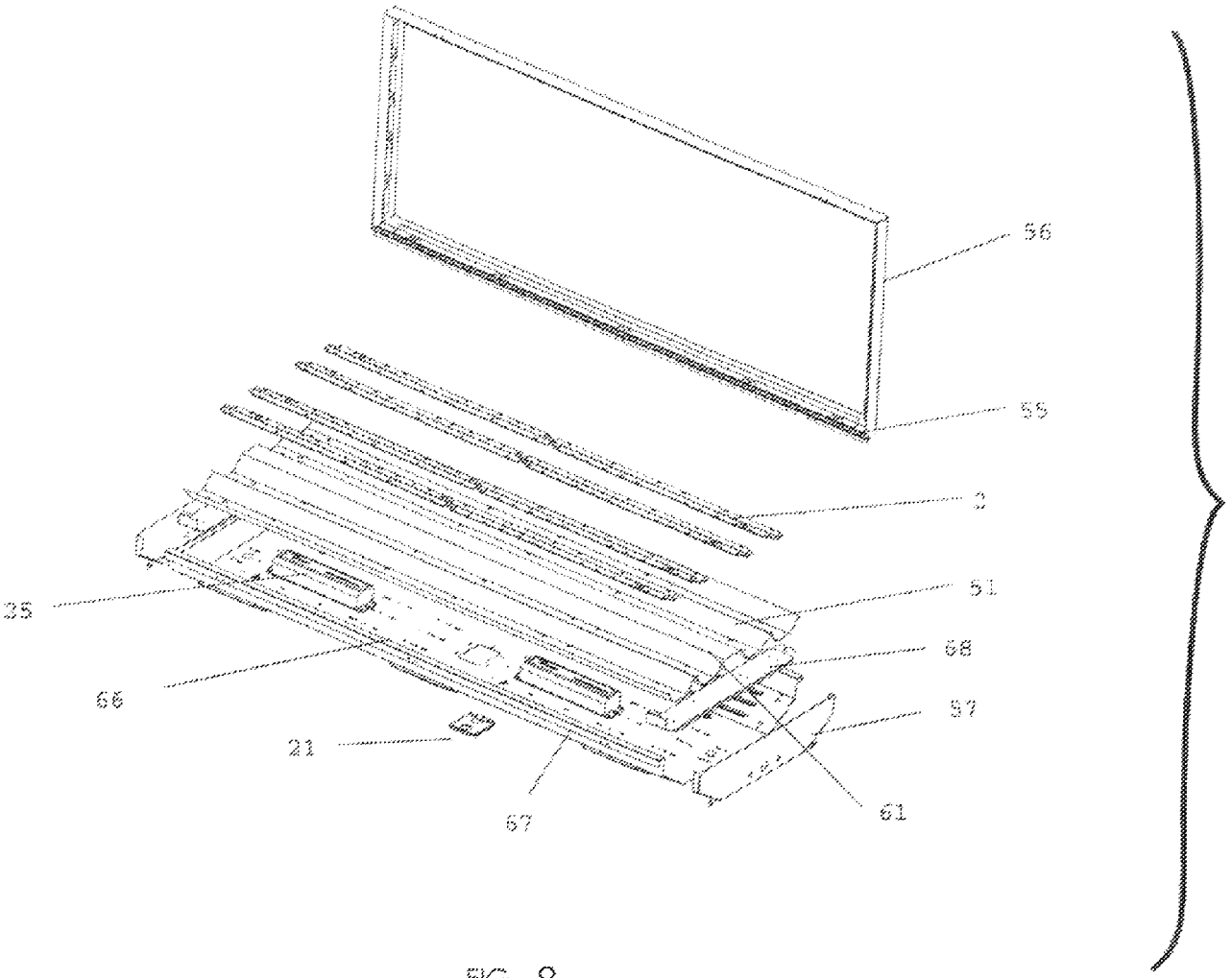
FIG. 8 illustrates the different components of the light fixture.

FIG. 8 illustrates the different components of the light fixture. LED strips (2) are attached to the reflector (51), which itself is attached to two brackets (68) (one on each side). The brackets (68) are pivotally attached to the body (66) at one end. The brackets (68) can be attached to the reflector (51) at one or more locations. The brackets (68) can be made of steel and the reflector (51) made of aluminum. The bracket (68) allows for moving the reflector (51) out of the way so a technician can access ballasts (25) while the light fixture is still hanging. As shown in FIG. 36, ballasts (25) reside under the space created by the central protrusion (61) of the reflector (51). This space allows for placing one or more ballasts (25) and electronically connecting the ballasts (25) to a power source. Also illustrated is the door (56)) which is pivotally attached to the body (66) with hinge (55).

Figure 9:
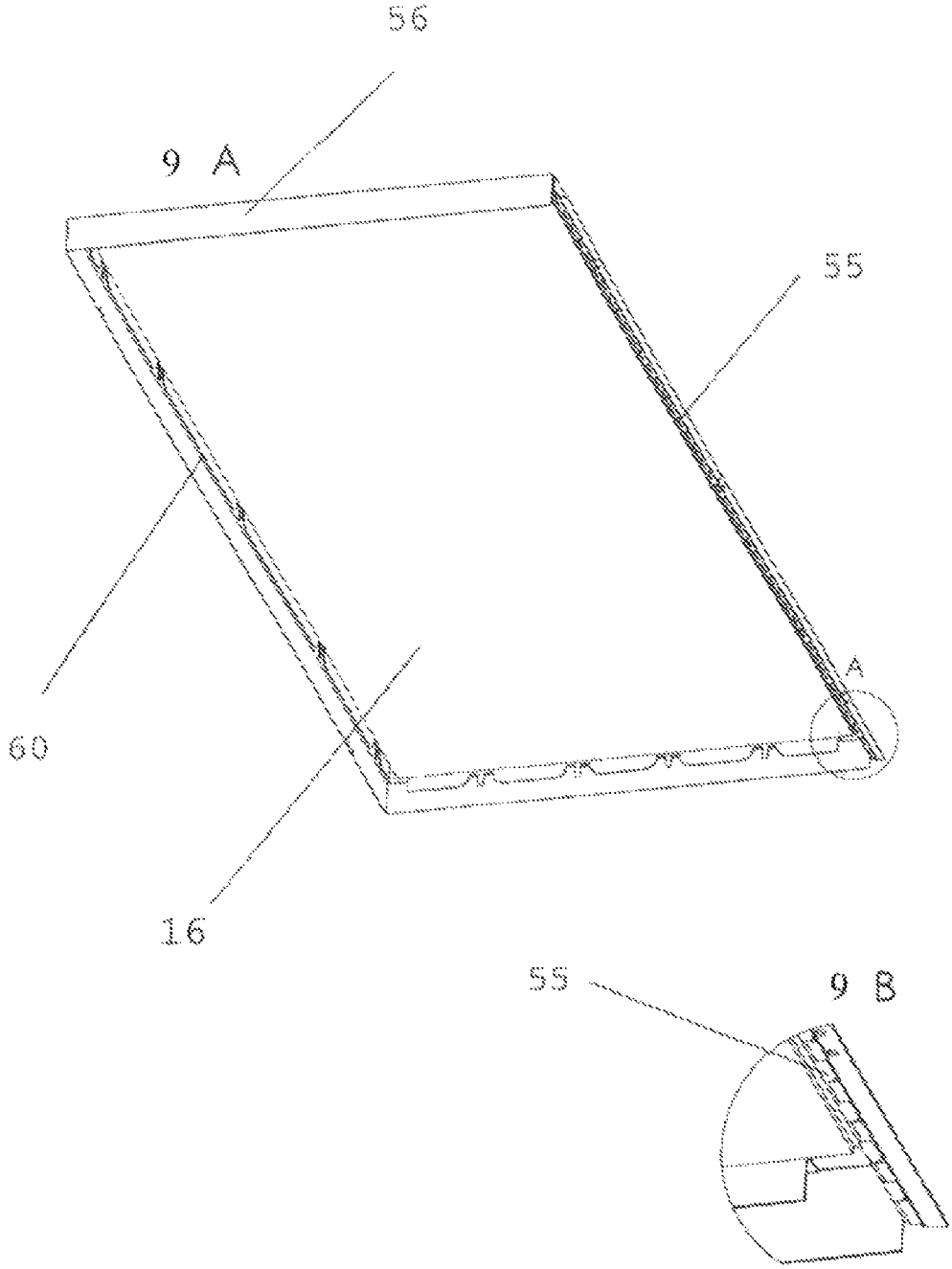
FIG. 9A illustrates a door of the light fixture that holds a lens.
FIG. 9B illustrates a door of the light fixture that holds a lens.

FIGS. 9A and 9B illustrate a door (56) that holds a lens (16). The door (56) has a frame and lens holders (60) are placed inside the frame of the door. The door (56) is pivotally attached to a hinge (55) as illustrated in FIG. 37B.

Figure 10:
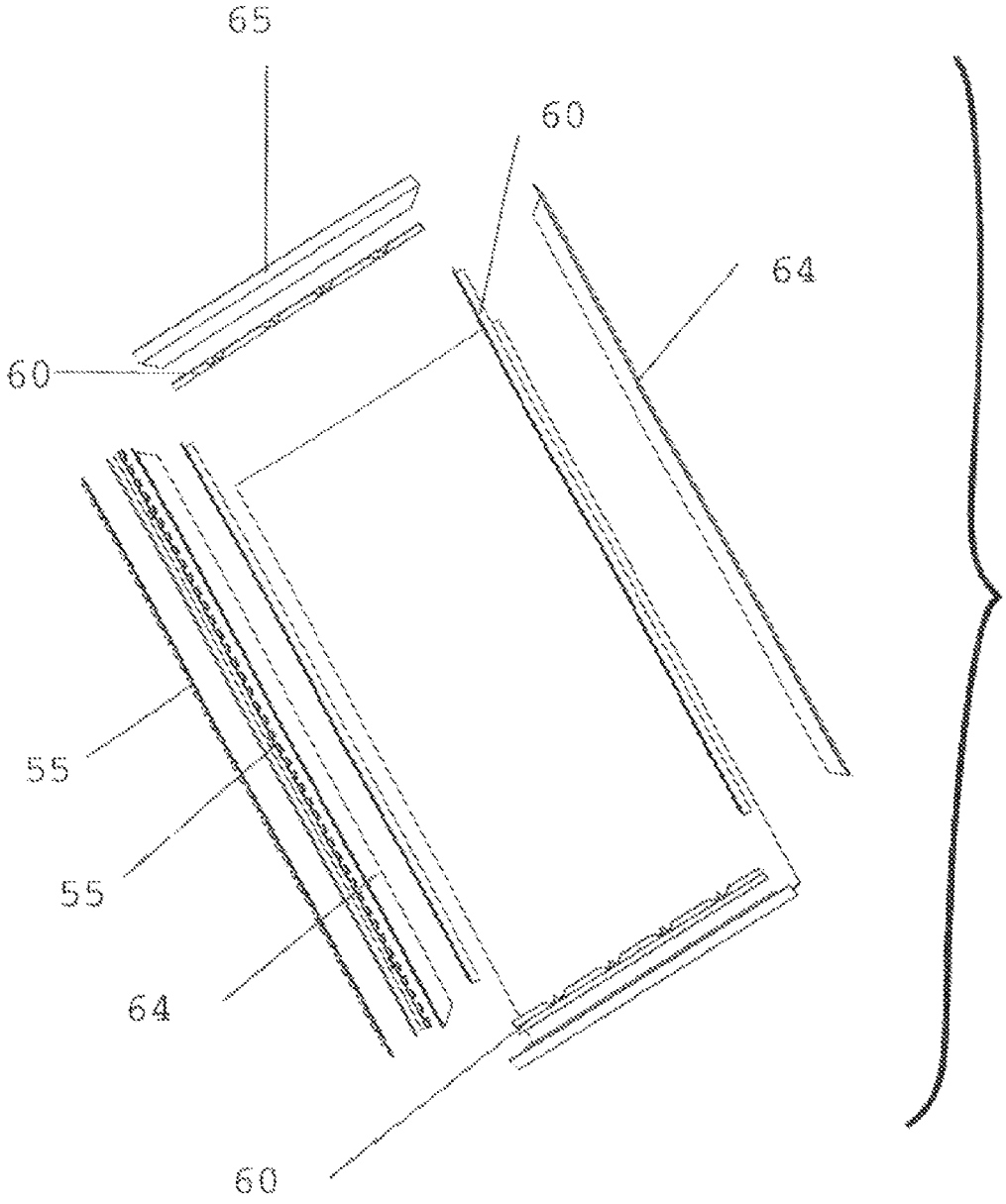
FIG. 10 illustrates the different components of a door.

FIG. 10 illustrates the different components of a door (56). The door (56) can be made from a frame (64, 65), lens holders (60), and a piano type hinge (55).

Figure 11:
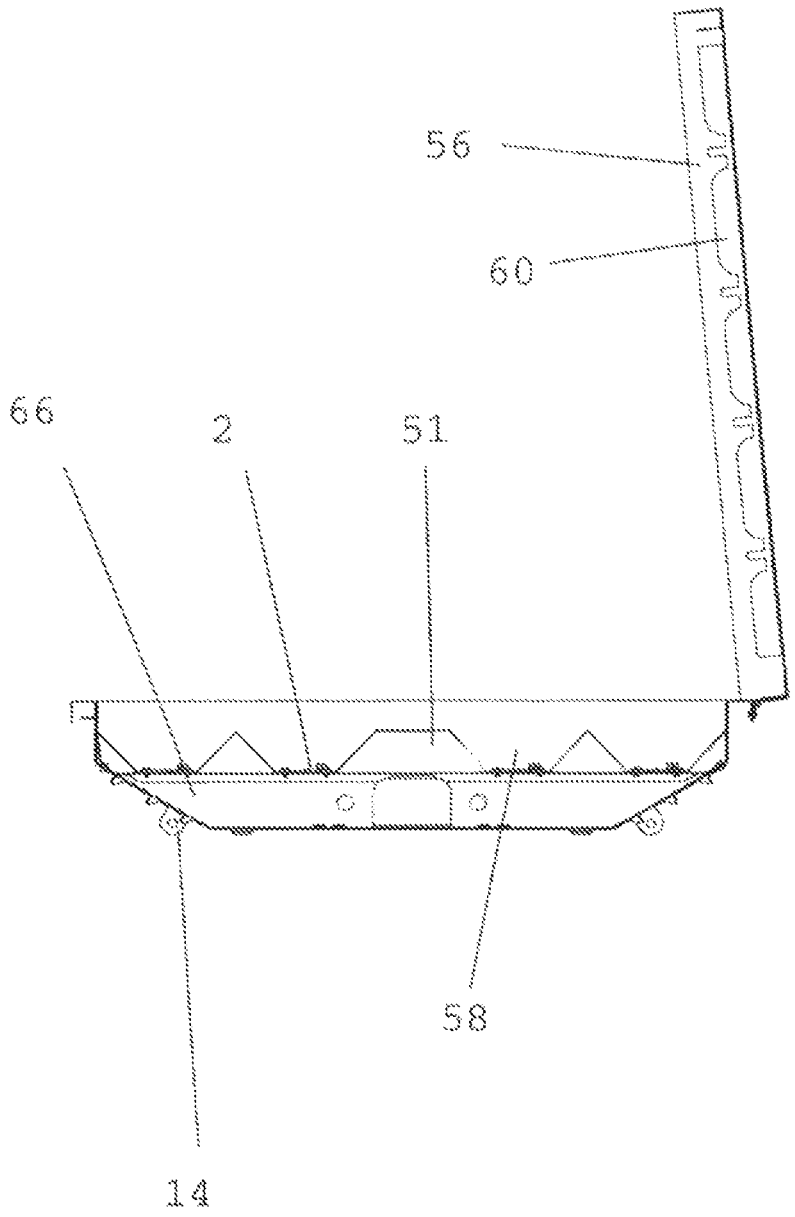
FIG. 11 illustrates a side view of the light fixture without the end frame.

FIG. 11 illustrates a side view of the light fixture without the end frame (57). LED strip (2) is sitting in each of the four cavities (58) of the reflector (51). A door (56) with a lens holder (60) is pivotally attached to the body (66) of the light fixture. Also illustrated in hanging member (14).

Figure 12:
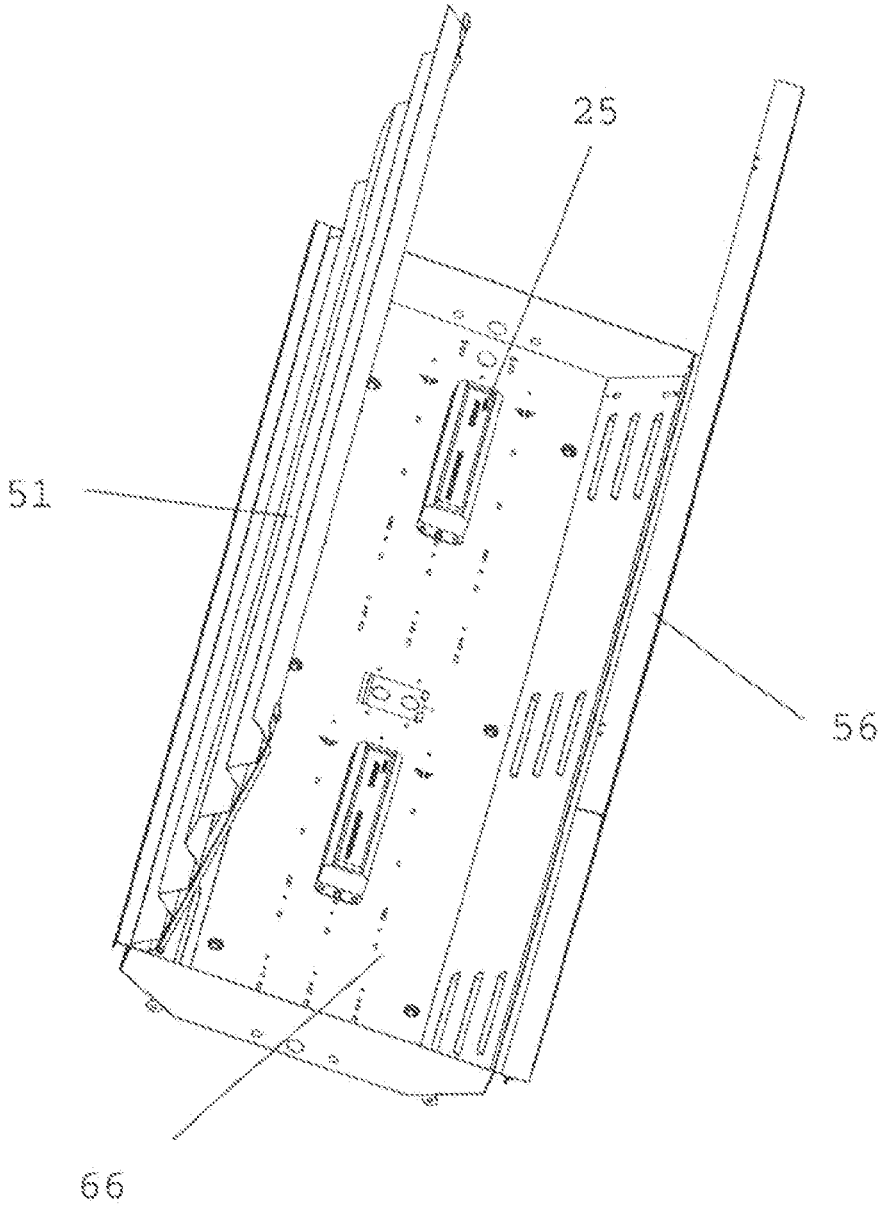
FIG. 12 illustrates the light fixture with the reflector and the door in an open position.

FIG. 12 illustrates the light fixture with the reflector (51) and the door (56) in an open position. The door (56) and the reflector (51) are designed to pivot in opposite directions, i.e., one pivots clock-wise and other pivots counter-clockwise. In such open position, the ballasts (25) attached to the body of the light fixture are accessible to a technician. The reflector (51) and the door (56) are pivotally attached to opposite sides of the body of the light fixture.

Figure 13:
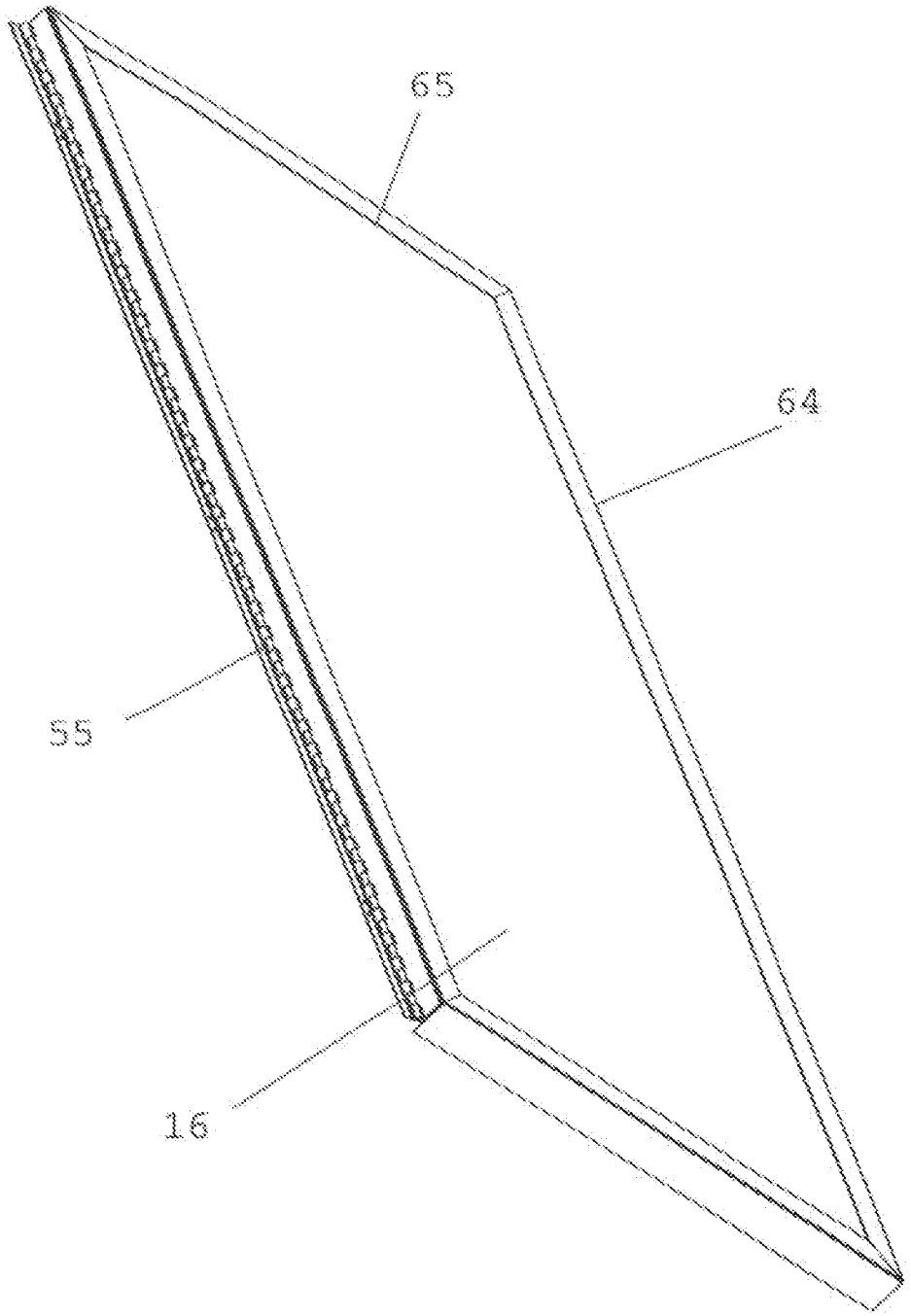
FIG. 13 illustrates a side perspective view of the door of the light fixture.
Figure 14:
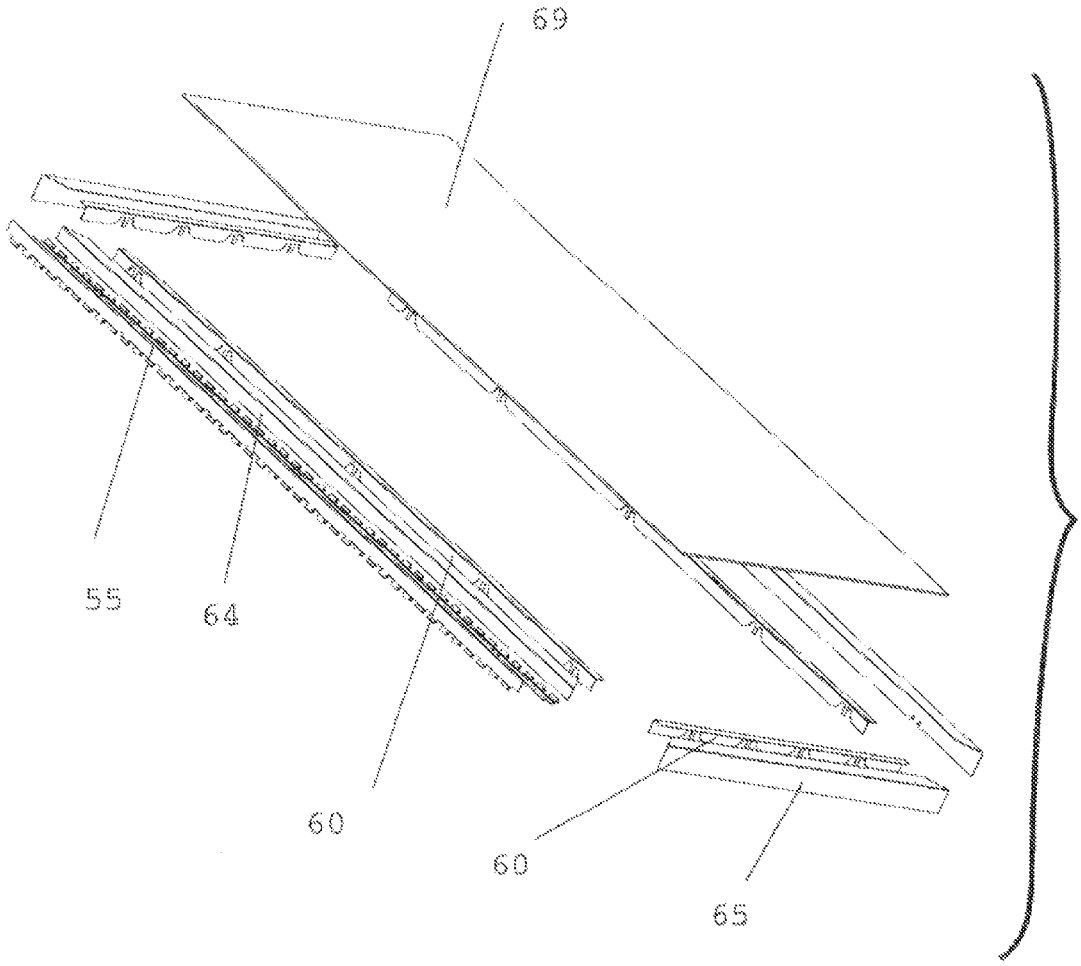
FIG. 14 illustrates a side perspective view of the door of the light fixtures.

FIGS. 13 and 14 illustrates a side perspective view of the door of the light fixture having a lens (16), a frame (64, 65), and a hinge (55) running alone one side for attachment to the body of the light fixture. Also illustrated in FIG. 14 is the lens holder (60).

Figure 15:
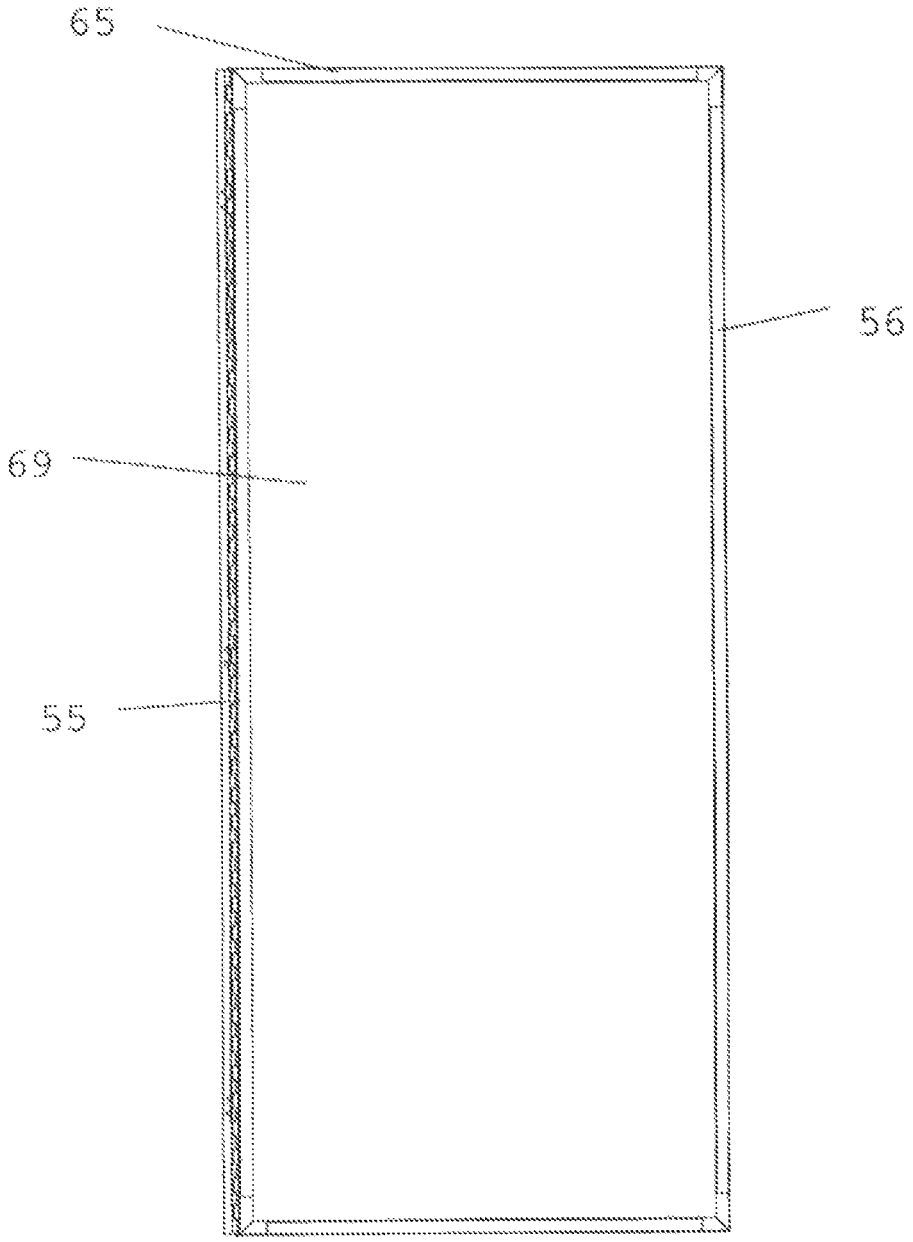
FIG. 15 illustrates assembled door with lens, frame, and hinge.
Figure 16:
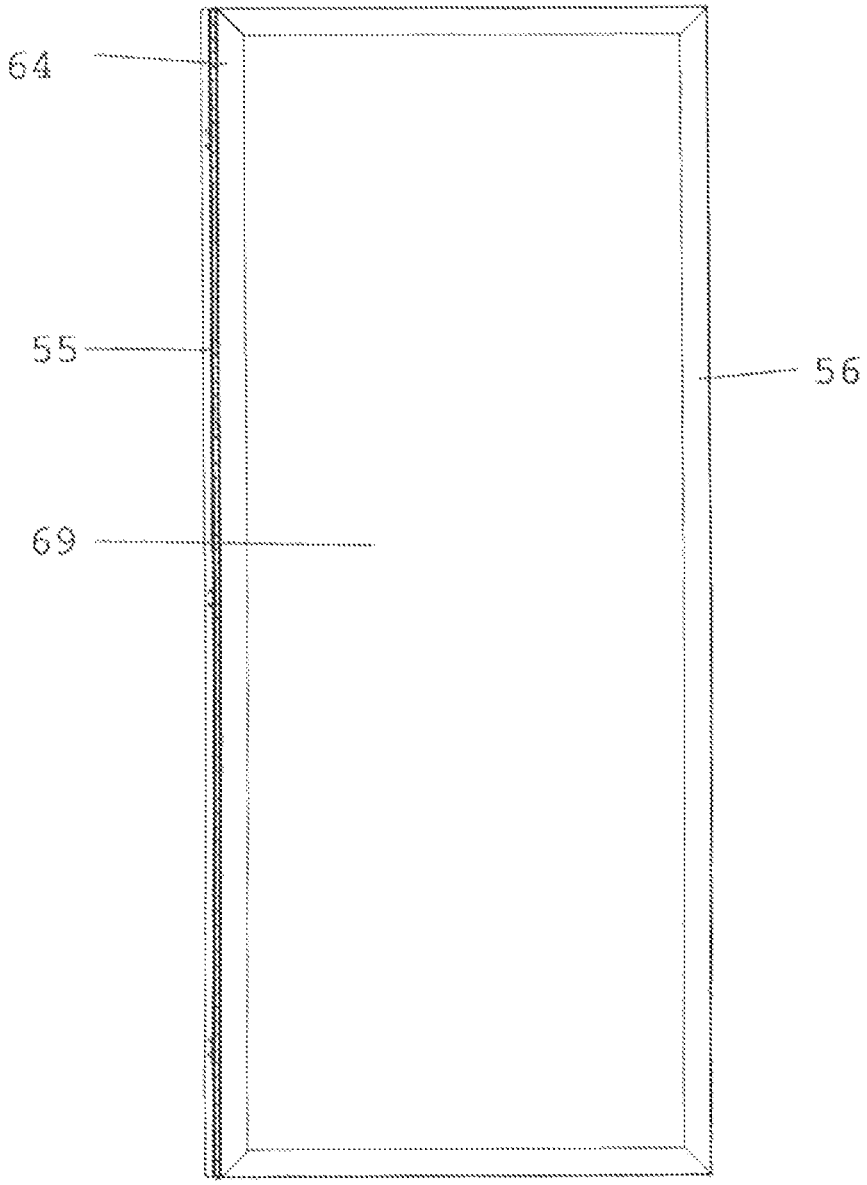
FIG. 16 illustrates assembled door with lens, frame, and hinge.

FIGS. 15 and 16 illustrates assembled door (56) with lens (69), frame (64, 65), and hinge (55). The door (56) is pivotally attached to the body (66) of the light fixture via the hinge (55). FIG. 15 illustrates the side of the door (56) facing inside of the fixture and FIG. 16 illustrates the side of the door (56) facing outside of the fixture.

FIG. 17 illustrates the bracket (68) which is attached to the reflector (51) and allows the reflector (51) to pivot. The bracket has a resting member (72) that passes through a T-slot (71) on the vertical portion of the body (73) and rests on outside of the vertical portion of the body (73). The bracket (68) with or without the reflector (51) can be removed from the T-slot (71) as needed. The resting members sits in the gap formed in between the mounting bracket (67) and the vertical portion if the body (73).

Figure 18A:
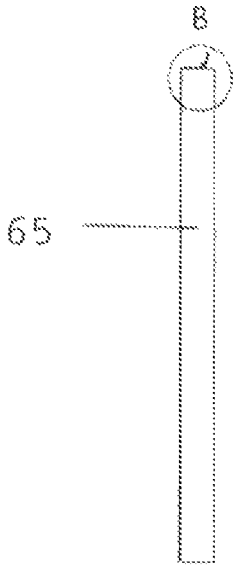
FIG. 18A illustrates short side of the door.
Figure 18B:
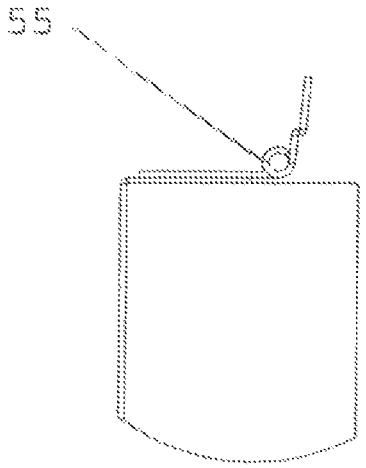
FIG. 18B illustrates short side of the door.

FIGS. 18(A and B) illustrate short side of the short side of the door frame (65) holding the lens. A side view of the hinge (55) attached to the short side of the door frame is visible in these views.

Figure 17B:
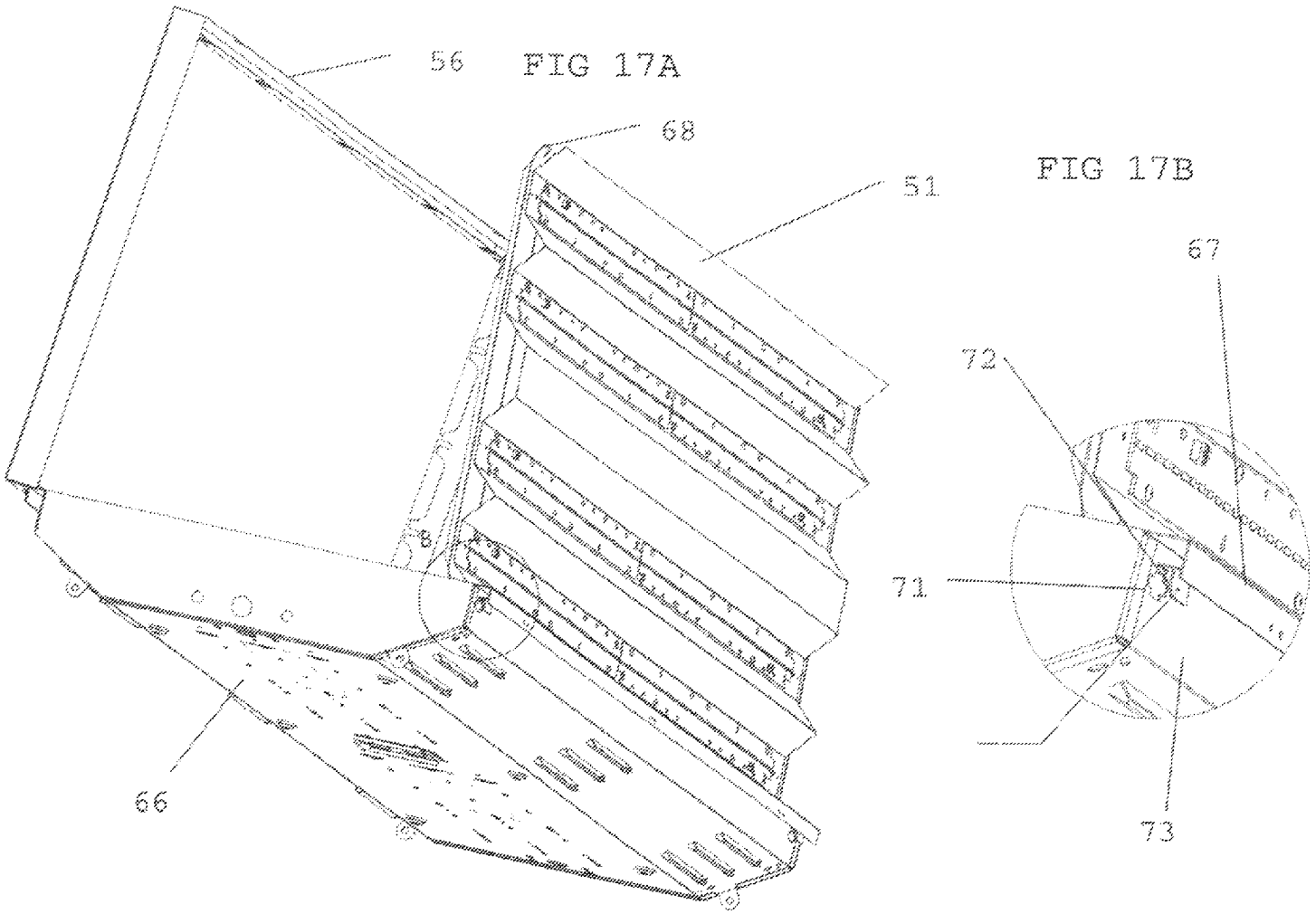
FIG. 17B illustrates a bracket attached.

FIG. 19 illustrates the bracket (68) with a second end (74) and a first end (75). The first end (75) of the bracket in this embodiment is removably attached to the bracket (68). The member (72) is positioned outside of the body through slot (71). The member (72) is attached to a short vertical neck (76) at a ninety degree angle. After moving member (72) through slot (71), member (72) stabilizes the bracket (68). As illustrated in FIG. 17B, the T-slot is wider at certain positions. The member (72) can move through the slot (72)

only at its widest point. The second end of the bracket (74) is screwed to the body to stabilize the bracket.

Figure 20:
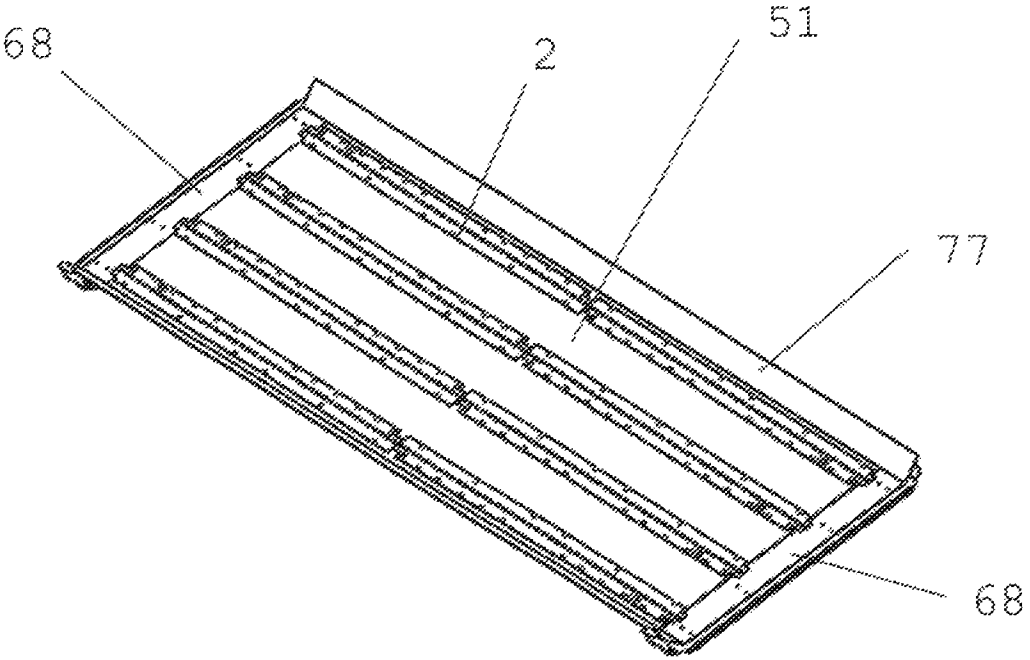
FIG. 20 illustrates a fixture body with a flat reflector.

FIG. 20 illustrates a fixture with a flat reflector (51). LED strips (2) are attached (such as with a screw) to the flat reflector (51). Additional side reflectors (77) can be used in this embodiment. The reflector (51) is attached to the brackets (68).

Figures 21A, 21B:
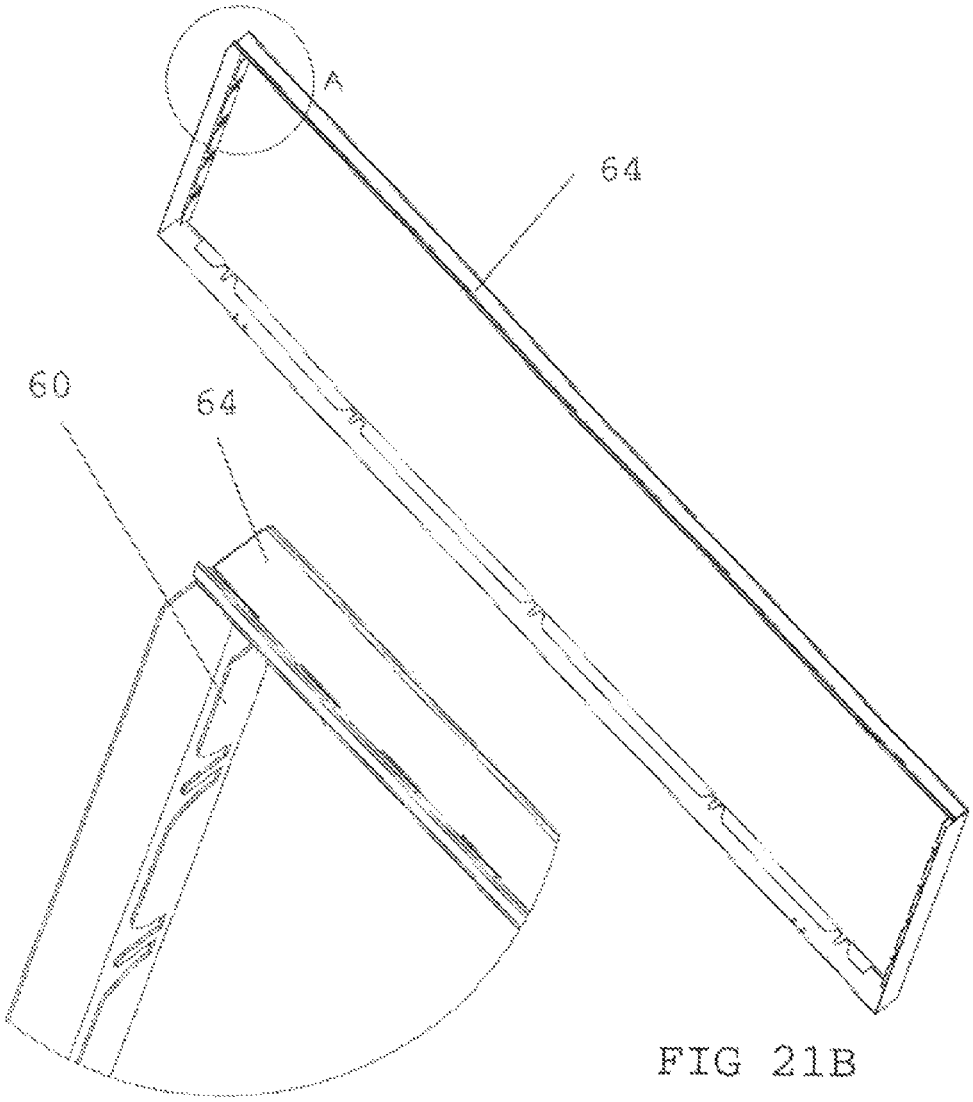
FIG. 21A illustrates frame of the door with lens holders.
FIG. 21B illustrates frame of the door with lens holders.

FIG. 21A illustrates frame (64) of the door (56) with lens holders (60), with a close up provided in FIG. 21B.

In one embodiment, provided is a body (66) that provides a compartment for placement of ballasts (25), reflector (51) and LED strips (2). The body can be made from a long horizontal portion that makes the top of the fixture. The compartment in the body (66) is formed by one or more portions that come downward, such as a downwardly slanting portion (54) and/or a vertically downward portion (73). All these portions run parallel to each other on the long side of the body (66) the end of the downwardly portion (73) can further comprise a mounting frame (67) which creates a U shaped gap. The body with all these portions can be made from a single piece of metal. An end frame (57) can then be placed at each end of the body to surround the compartment formed by the body. The end frames are perpendicular (transverse) in direction (90 degrees) to the long side of the body. One or two (or more) ballasts (25) can be placed in the compartment formed by the body (66), preferably by attaching the ballast (25) inside of the compartment to the horizontal top portion of the body. The body (66) can have a T-slot (71) on one or more of its downwardly portions, such as a vertically downwardly section (73) for resting a bracket in perpendicular (transverse) direction to the long side of the body (66) and in parallel fashion to the end frame (57). The bracket (68) sits on the T-slot (71) with a member (72) hanging out from the body and being in a gap firmed in between the mounting frame (67) and the body (66). A reflector (51) is attached to the brackets (68) with screws. The reflector (51) can be flat or have protrusions, with at least a central protrusion (61) that forms a cavity in between the body (66) and the reflector (51) that allows for placement of ballasts (25). LED strips (2) are placed on the reflector (51) on the side of the reflector (51) not facing the body (66). The bracket (68) holding the reflector (51) can be pivoted or removed altogether. A door (56) with a lens (16) is pivotally attached with a hinge (55) in parallel fashion with the body (66) and in a closed position covers the compartment that is formed by the body (66) and the end frame (57). The door is secured by matching screw holes (70) to the mounting frame (67). The hinge (55) is attached to the mounting frame (67) on one side of the body (66) and the door (56) is secured to the screw holes (70) on the additional mounting frame (67). When a technician seeks to access the light fixture, the technician has to first remove the screws to free the door (56), and pivot the door (56) to one side. The technician can then pivot the reflector (51) to opposite direction of the door (56) or even remove the reflector (51) by removing the bracket from the T-slot.

REFERENCE TO NUMBERS

2. LED Strip
16. lens
21. hanger
25. ballast
51. Reflector
52. vents
53. horizontal portion
54. slanting portion
55. hinge
56. Door
57. End Frame
58. Cavity
59. Opening for passage of wires
60. Lens holder
61. Reflector central protrusion
62. Reflector triangular protrusion
63. Reflector slanting protrusion
64. Door frame long side
65. Door frame short side
66. body
67. Mounting frame
68. bracket
70. screw holes
71. T-slot
72. Resting member
73. Vertical portion
74. Second end of bracket
75. first end of bracket
76. neck attached to resting member
77. side reflector

What is claimed is:

1. A light fixture comprising:
a) a body for attaching one or more ballast;
b) a bracket having a first and a second end that is pivotally attached at the first end to the body;
c) a reflector, for placement of one or more LED (light emitting diode) strips, attached to the bracket;
d) a door pivotally attached to the body; and
e) a slot on the body for having the first end of the bracket go through to allow for the bracket to pivot; wherein the slot is selected from the group consisting of one or more of a T-slot and a slot placed in a vertically downwardly portion of the body.

2. The fixture of claim 1, wherein the ballast is accessed by pivoting the reflector and the door in opposite directions.

3. The fixture of claim 1, wherein the reflector has cavities formed by protrusions for placement of multiple LED strips, with one protrusion having a flat top surface forming a space in between the reflector and the body for placement of the ballast.

4. The fixture of claim 1, wherein the reflector is flat.

5. The fixture of claim 1, wherein the reflector is comprised of five protrusions, with a central protrusion having a horizontal top portion, two triangular protrusions, and two slanting protrusions.

6. The fixture of claim 1, wherein the body is comprised of a top horizontal portion that borders downwardly slanting portions, with each slanting portion further bordering downwardly vertical portions, with all portions running parallel in respect to each other.

7. The fixture of claim 1, further comprising an end frame attached in transverse direction to the body.

8. The fixture of claim 1, where the body is made from a single piece of metal.

9. The fixture of claim 1, wherein the bracket rests on the body with a hanging member at the first end and is detachably attached to the body at the second end.

10. The fixture of claim 1, wherein the slot is the T-slot.

11. The fixture of claim 1, wherein the slot is in the vertically downwardly portion of the body.

12. The fixture of claim 1, wherein the reflector is attached to the bracket with screws.

13. The fixture of claim 1, further comprising LED strips placed on the reflector on the side of the reflector not facing the body.

14. The fixture of claim 1, wherein the bracket holding the reflector can be removed altogether through the slot on the body.

15. The fixture of claim 1, further comprising a mounting frame attached to the body for securing the door.

16. The fixture of claim 2, wherein the door is secured by matching screw holes on a mounting frame.

17. The fixture of claim 6, further comprising one or more ballasts in a compartment formed by the body by attaching the one or more ballasts inside of the compartment to the horizontal top portion of the body.

18. The fixture of claim 6, further comprising a mounting frame attached to the lower tip of the downwardly portion of the body and running parallel with the body.

19. The fixture of claim 9, wherein the bracket sits on the slot with a member hanging out from the body and being in a gap formed in between a mounting frame and the body.

20. The fixture of claim 18, wherein the mounting frame creates a U shaped gap.

21. A light fixture comprising:

a) a body for attaching one or more ballast;

b) a bracket having a first and a second end that is pivotally attached at the first end to the body; and c) a reflector for placement of one or more LED (light emitting diode) strips attached to the bracket; and d) a slot on the body for having the first end of the bracket go through to outside of the body to allow for the bracket to pivot.

22. The fixture of claim 21, wherein the bracket holding the reflector can be removed altogether through the slot on the body.

* * * * *